US006685516B2

(12) United States Patent
Tsuboguchi

(10) Patent No.: US 6,685,516 B2
(45) Date of Patent: Feb. 3, 2004

(54) AZIMUTH PROPELLER DEVICE

(75) Inventor: Katsunori Tsuboguchi, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/162,666

(22) Filed: Jun. 6, 2002

(65) Prior Publication Data

US 2003/0003818 A1 Jan. 2, 2003

(30) Foreign Application Priority Data

Jun. 29, 2001 (JP) ..... P2001-199416

(51) Int. Cl.[7] ..... B63H 21/17

(52) U.S. Cl. ..... 440/6; 440/53; 114/144 RE; 310/64; 310/87

(58) Field of Search ..... 440/6, 53, 76; 310/52, 54, 58, 64, 87; 114/144 R, 144 RE

(56) References Cited

U.S. PATENT DOCUMENTS

| | | | | | |
|---|---|---|---|---|---|
| 2,714,866 | A | * | 8/1955 | Pleuger et al. | 440/6 |
| 2,801,821 | A | * | 8/1957 | Burger | 415/178 |
| 2,824,984 | A | * | 2/1958 | Harris | 310/87 |
| 3,593,050 | A | * | 7/1971 | Ware | 310/87 |
| 3,791,331 | A | * | 2/1974 | Dilley | 440/6 |
| 3,814,961 | A | * | 6/1974 | Nelson et al. | 310/87 |
| 3,936,681 | A | * | 2/1976 | Liebe | 310/54 |
| D260,395 | S | * | 8/1981 | Kappas | D15/4 |
| 4,445,046 | A | * | 4/1984 | Allegre et al. | 290/52 |
| 5,078,628 | A | * | 1/1992 | Garis, Jr. | 440/6 |
| 5,101,128 | A | * | 3/1992 | Veronesi et al. | 310/54 |
| 5,403,216 | A | * | 4/1995 | Salmi et al. | 440/6 |
| 6,028,380 | A | * | 2/2000 | Gevelt et al. | 310/52 |
| 6,312,298 | B1 | * | 11/2001 | Schuring | 440/6 |
| 6,485,339 | B1 | * | 11/2002 | Hartig et al. | 440/6 |

FOREIGN PATENT DOCUMENTS

| | | | | |
|---|---|---|---|---|
| EP | 581966 | A1 * | 2/1994 | H02K/9/19 |
| EP | 1270402 | A1 * | 1/2003 | B63H/5/125 |
| GB | 2260805 | A * | 4/1993 | B63H/5/14 |
| WO | WO 9749605 | A1 * | 12/1997 | B63H/23/24 |

* cited by examiner

*Primary Examiner*—S. Joseph Morano
*Assistant Examiner*—Ajay Vasudeva
(74) *Attorney, Agent, or Firm*—Wenderoth, Lind & Ponack, L.L.P.

(57) ABSTRACT

An azimuth propeller device includes an azimuth pod, a POD propeller member provided with the azimuth pod, and a motor which drives the POD propeller member. The motor is provided inside the azimuth pod, and at least one radiation member for releasing the heat generated by the motor is provided at an outer periphery of the azimuth pod.

7 Claims, 4 Drawing Sheets

AZIMUTH PROPELLER DEVICE

BACKGROUND OF THE INVENTION

1. Field of the Invention

The present invention relates to an azimuth propeller device. More specifically, the present invention relates to an azimuth propeller device including a motor for driving a POD propeller.

2. Description of Related Art

In general, a conventional ship is provided with a propeller and a rudder separately provided with the propeller, which are attached to the stern of the ship so that the driving force for the ship is exerted by the propeller, and operations, such as turning of the ship, are performed by the rudder.

Recently, however, the propeller used for driving the ship and the rudder used for operating the ship are integrated, and an azimuth propeller device, simply called an azimuth propeller, which is attached to the ship to be rotatable in the vertical direction of the ship, has been developed.

The structure of a conventional azimuth propeller device will be briefly described with reference to FIGS. 3 and 4. FIG. 3 is a schematic diagram showing an attachment of an azimuth propeller device at the stern portion of a ship. FIG. 4A is a diagram showing a partial cross-sectional view of the right hand side of the azimuth propeller device. FIG. 4B is a diagram showing a cross-sectional view of the azimuth propeller device shown in FIG. 4A taken along the line A—A. In the figures, the numeral 1 indicates a rear portion of the ship's bottom, 2 indicates an azimuth pod, 3 indicates a shaft, 4 indicates a current plate member, 5 indicates a POD propeller member, 6 indicates a propeller shaft, 7 indicates a stator, 8 indicates a rotor, 9 indicates a motor, and 10 indicates an azimuth propeller device.

As shown in the figures, the azimuth propeller device 10 is rotatably attached to the rear portion of the ship's bottom 1 via the shaft 3. The azimuth propeller device 10 includes the POD propeller member 5, the azimuth pod 2, and the current plate member 4. The POD propeller member 5, which exerts the driving force for the ship, may be attached to the front or back of the azimuth propeller device 10. The azimuth pod 2 accommodates a propeller drive mechanism, such as the motor 9, on the inside thereof The current plate member 4 is integrally fixed to the upper portion of the azimuth pod 2 and has a streamline cross sectional shape. The current plate member 4 is attached to the lower portion of the shaft 3 which extends in the vertical direction, and the upper portion of the shaft 3 is coupled with a driving mechanism (not shown in the figures), which is disposed in the hull so that the shaft 3, the current plate member 4, the azimuth pod 2, and the POD propeller member 5 are integrally rotated.

By using the azimuth propeller device 10 having the above mentioned structure, it becomes possible to drive the ship using the driving force generated by rotating the POD propeller member 5, and to obtain steering function by rotating the azimuth propeller device 10 with respect to the rear portion of the ship's bottom 1 to change the travelling course of the ship.

Note that there are two types for the azimuth propeller device 10. One in which the motor 9 for outputting a driving force for the POD propeller 5 is disposed in the azimuth pod 2 as shown in FIG. 4A, and the other in which a driving force is received from a driving source (not shown in the figures), such as a motor, disposed in the hull. The azimuth propeller device 10 shown in FIGS. 4A and 4B has a structure in which the rotor 8 is rotated together with the propeller shaft 6 with respect to the stator 7, which is fixed to the inside wall of the hollow azimuth pod 2. In order to handle the heat generated by driving the motor 9, an air-cooling system, in which cooling air supplied into the azimuth pod 2 from the hull is circulated, is adopted for the conventional azimuth propeller device 10.

For the above-mentioned air-cooling system for the azimuth propeller device, however, since it forcibly circulates the cooling air, a number of components become necessary, such as a supply source of the cooling air, a passage for the cooling air, an impelling means such as a fan for the cooling air, and a driving source for actuating the impelling means. For this reason, it becomes necessary, from the viewpoint of structure, to secure space for installing the passage, the impelling means, etc., in at least one of the azimuth propeller device and the hull. Accordingly, this is disadvantageous in terms of decreasing the size or cost of the azimuth propeller device. In addition, since power is consumed for the cooling system, the running cost is also increased.

SUMMARY OF THE INVENTION

The present invention takes into consideration the above-mentioned circumstances, and has as an object to provide an azimuth propeller device which is capable of completely eliminating the necessity of cooling the motor, etc., using the air-cooling system or keeping it down to a minimum level.

In order to achieve the above object, the present invention provides an azimuth propeller device including an azimuth pod, a POD propeller member provided with the azimuth pod, a motor which drives the POD propeller member, the motor being provided inside the azimuth pod, and at least one radiation member provided with an outer periphery of the azimuth pod.

In accordance with another aspect of the present invention, the radiation member is a fin extending in the front and back direction of the azimuth pod.

In yet another aspect of the present invention, the fin is twisted in the rotation direction of the POD propeller member from the front to back of the fin.

According to the above azimuth propeller device, since at least one radiation member is provided with the outer periphery of the azimuth pod, it becomes possible to effectively release the heat which is generated by the rotation of the motor inside the azimuth pod into the surrounding water via the radiation member. That is, it becomes possible to effectively carry out a water-cooling operation using water of the ocean, a river, a lake, etc., in which the ship is traveling, and hence the air cooling operation can be eliminated or decreased to a minimum level. Accordingly, it has a remarkable effect a reduction in the size and cost of the azimuth propeller device.

Also, since at least one of the fins extending in the front and back direction of the azimuth pod is adopted as a radiation member, it becomes possible to secure a large heat transfer area to improve the radiation efficiency.

Moreover, since the fin is twisted in the rotation direction of the POD propeller member from front to back of the fin, a water flow adjusting effect can be obtained in addition to the above-mentioned radiation effect. Accordingly, the present invention can also contribute to improvement in driving force.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of particular preferred embodiments, set out below to enable one to build and use particular implementations of the invention, is not intended to limit the enumerated claims, but to serve as particular examples thereof The azimuth propeller device according to an embodiment of the present invention will be described with reference to FIGS. 1A and 1B. Note that in the following figures, elements which are the same as those described in the prior art are indicated by using the same numerals, and the explanations thereof will be omitted.

Figure 1B:
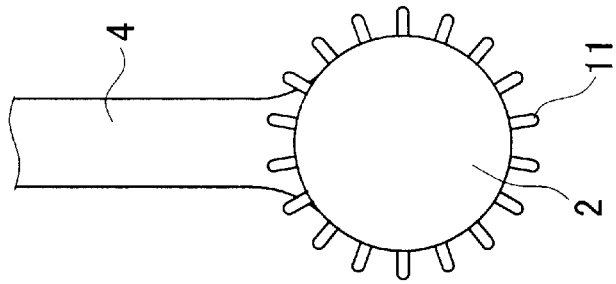
FIG. 1B is a diagram showing a front elevational view of the azimuth propeller device shown in FIG. 1A.
Figure 1A:
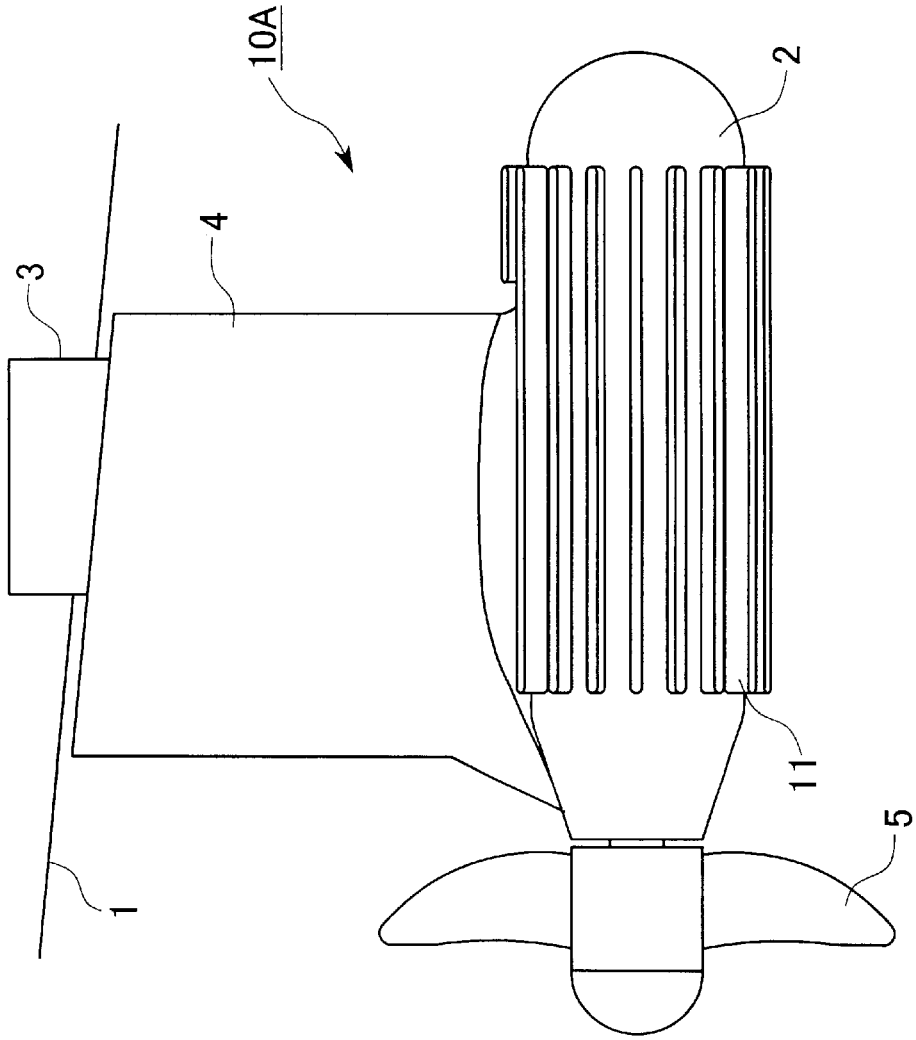
FIG. 1A is a schematic diagram showing a side view of an azimuth propeller device according to an embodiment of the present invention.

In the azimuth propeller device according to the first embodiment of the present embodiment shown in FIGS. 1A and 1B, the numeral 1 indicates a rear portion of the ship's bottom, 2 indicates an azimuth pod, 3 indicates a shaft, 4 indicates a current plate member, 5 indicates a POD propeller member, 10A indicates an azimuth propeller device, and 11 indicates a (plurality of) radiation fins (i.e., a radiation member).

As shown in the figures, the azimuth propeller device 10A is rotatably attached to the rear portion of the ship's bottom 1 via the shaft 3. In this specification, the term "the rear portion of the ship's bottom" means a portion of the bottom of a ship which is located at the back of a hull with respect to the direction of travel of the ship. Accordingly, the azimuth propeller device 10A is located beneath the surface of the water of the ocean, a river, a lake, etc., in which the ship travels.

The azimuth propeller device 10A includes the azimuth pod 2 accommodating a motor for driving the POD propeller (not shown in the figures) on the inside thereof, to which the POD propeller member 5 that exerts the driving force for the ship by driving water backwards, is attached, either to the front or back thereof (the back in the device 10A shown in FIG. 1A). The current plate member 4 having a streamlined cross sectional shape, is integrally fixed to the upper portion of the azimuth pod 2. The current plate member 4 is attached to the lower portion of the shaft 3 which extends in the vertical direction, and the upper portion of the shaft 3 is coupled with a driving mechanism (not shown in the figures) which is disposed in the hull so that the shaft 3, the current plate member 4, the azimuth pod 2, and the POD propeller member 5 can be integrally rotated.

As shown in FIGS. 1A and 1B, a number of radiation fins 11 are attached to the outer periphery of the azimuth pod 2 so as to extend therefrom. Each of the radiation fins 11 is a plate-like member extending in the front-to-back direction of the azimuth pod 2, i.e., the travelling direction by the driving force of the POD propeller member 5. It is preferable to use a member having excellent thermal conductivity for the radiation fins 11.

Note that although eighteen of the radiation fins 11 are radially attached to the outer periphery of the azimuth pod 2 with an equal interval between each other, the present invention is not limited to this particular configuration.

In the azimuth propeller device 10A having the above-mentioned structure, heat generated from the motor (not shown in the figures) for rotating the POD propeller member 5 is transmitted to each of the radiation fins 11 via the wall of the azimuth pod 2, and is released into the surrounding water from the surface of each radiation fin 11. That is, the azimuth pod 2 is cooled by means of a water-cooling system via the radiation fins II according to an embodiment of the present invention. For this reason, components required in the above conventional art, such as a power source for the air-cooling system, a driving source for actuating the impelling means, and a passage for the cooling air, become unnecessary, and hence, not only can the space, energy consumption, and cost be reduced, but also the durability and the reliability of the azimuth propeller device can be improved according to the embodiment of the present invention.

Also, if the entire heating value cannot be covered by the water-cooling system of the embodiment of the present invention, such as for the case where the heating value of the motor is large, it is possible to use the water-cooling system of the present invention together with the conventional air-cooling system. In such a case, since the burden for the air-cooling system can be eased as compared with that in the conventional system, the size of the fan or of the passage for the cooling air can be decreased.

Figure 2B:
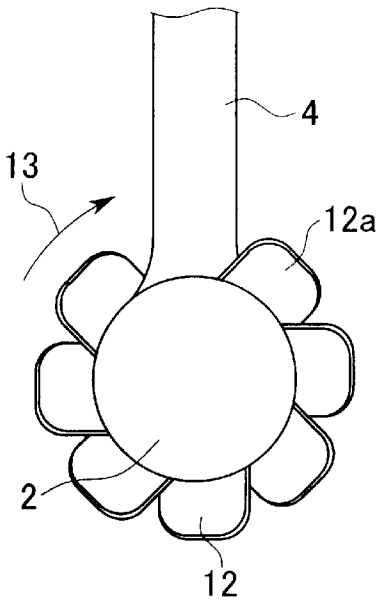
FIG. 2B is a diagram showing a front elevational view of the azimuth propeller device shown in FIG. 2A.
Figure 2A:
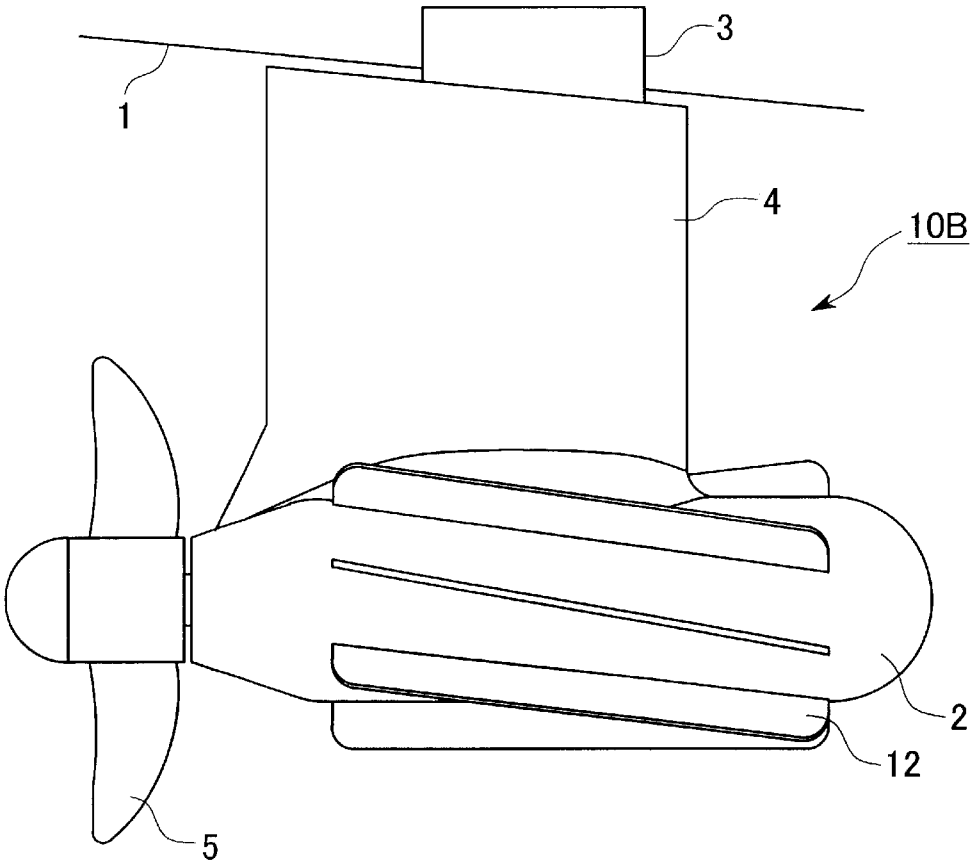
FIG. 2A is a schematic diagram showing a side view of an azimuth propeller device according to a modified embodiment of the present invention.
Figure 3:
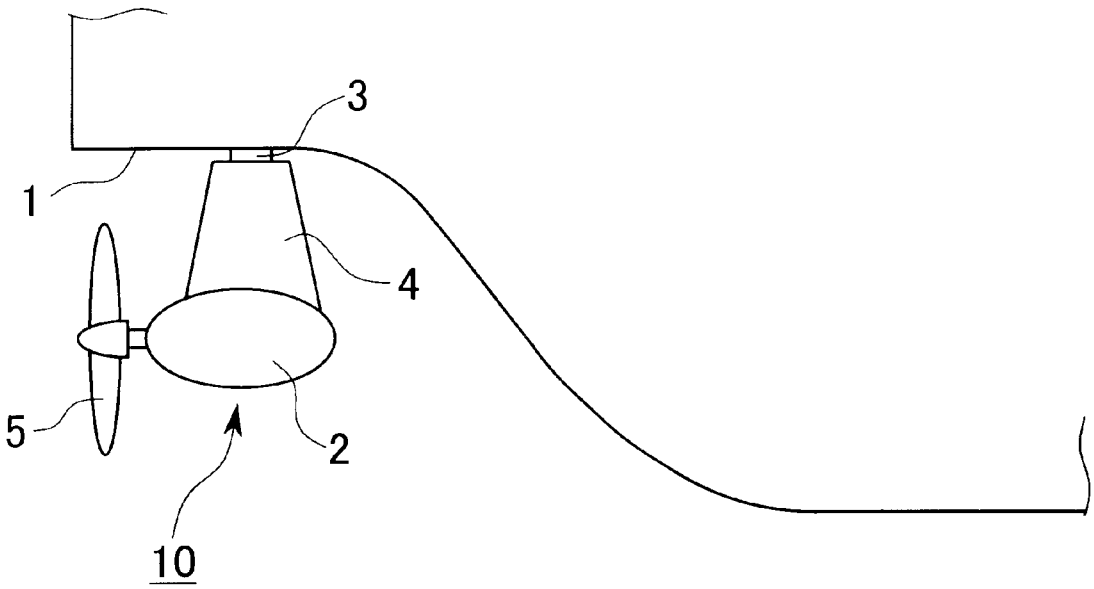
FIG. 3 is a schematic diagram showing attachment of a conventional azimuth propeller device at the stern portion of a ship.
Figure 4A:
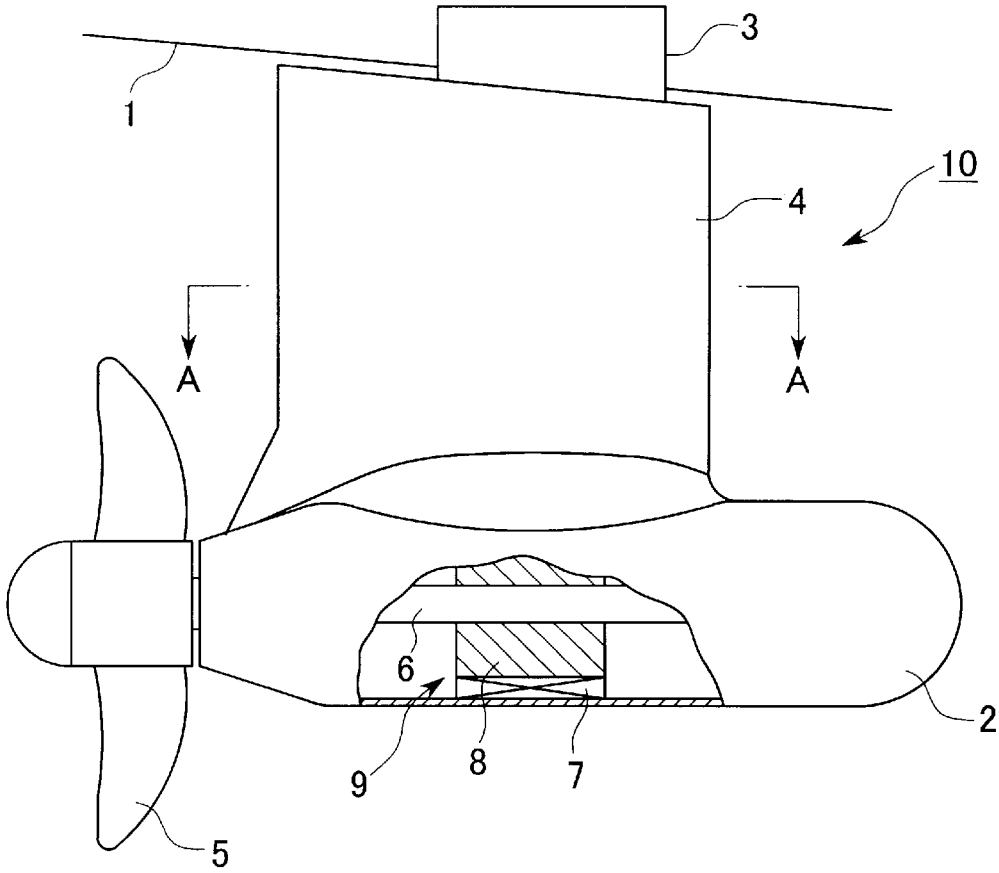
FIG. 4A is a schematic diagram showing a side view of a conventional azimuth propeller device.
Figure 4B:
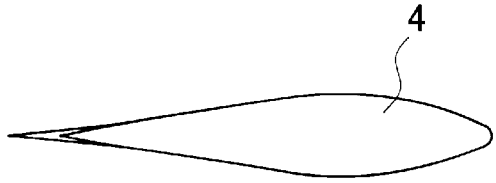
FIG. 4B is a diagram showing a cross-sectional view of the azimuth propeller taken along the line A—A shown in FIG. 4A.

Next, a modified example of the above-mentioned embodiment will be described with reference to FIGS. 2A and 2B. Note that elements which are the same as those described in the embodiment shown in FIGS. 1A and 1B are indicated by using the same numerals, and the explanations thereof will be omitted.

In this modified embodiment, a current plate fin 12 is adopted as a radiation member. The current plate fin 12 is formed by, in general, twisting the above-mentioned fin 11 in the rotation direction of the POD propeller 5 from the front to the back thereof In the example shown in FIGS. 2A and 2B, the POD propeller 5 rotates in a clockwise direction viewed from the front (in the traveling direction) of the azimuth propeller device 10B as indicated by the arrow 13 in FIG. 2B, and each of the current plate fins 12 is angled or inclined from the front toward the back. The inclination is due to the twist of the current plate fin 12 so as to upturn the tail portion of the current plate fin 12 in the rotation direction of the POD propeller 5 with respect to the axis of the azimuth pod 2. That is, an inclination surface 12*a* of the current plate fin 12 is formed along the flow of water which is drawn by the POD propeller 5.

If the current plate fins 12 having the above-mentioned structure are adopted, it becomes possible to obtain a water flow adjusting function for the water drawn by the POD propeller 5 in addition to the above-mentioned water-cooling function. Accordingly, it becomes possible to decrease the loss, and hence, the driving force exerted by the rotating the POD propeller 5 can be increased.

Note that the structures of the azimuth propeller device according to the embodiments of the present invention are not limited to those described above, and can be modified within the scope of the present invention. For instance, a member having an excellent thermal conductive property may provided between the azimuth pod and the motor so as to further enhance the thermal conduction from the motor.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. An azimuth propeller device, comprising:

an azimuth pod;

a POD propeller member provided with said azimuth pod;

a motor which drives said POD propeller member, said motor being provided inside said azimuth pod; and at least one radiation member provided on outer periphery of said azimuth pod on the outside of said azimuth pod, wherein said at least one radiation member comprises at least one fin positioned so as to contact with surrounding water when said azimuth propeller device is in the water.

2. The azimuth propeller device of claim 1, wherein said at least one fin extends in a front and back direction of said azimuth pod.

3. An azimuth propeller device, comprising:

an azimuth pod;

a POD propeller member provided with said azimuth pod;

a motor which drives said POD propeller member, said motor being provided inside said azimuth pod; and at least one radiation member provided at an outer periphery of said azimuth pod;

wherein said radiation member is a fin extending in a front and back direction of said azimuth pod, and said fin is twisted in the rotation direction of said POD propeller member from the front to back of said fin.

4. An azimuth propeller device for a ship, comprising:

an azimuth pod;

a POD propeller member provided with said azimuth pod;

a motor which drives said POD propeller member, said motor being provided inside said azimuth pod; and at least one radiation member comprising a fin provided on the outside of said azimuth pod and positioned on said azimuth pod so as to be operable to, when said motor drives said POD propeller member in surrounding water, contact with the surrounding water so as to cool said motor.

5. The azimuth propeller device of claim 4, wherein said at least one radiation member comprises a plurality of fins spaced circumferentially about said azimuth pod.

6. The azimuth propeller device of claim 4, wherein said at least one fin extends in a front to back direction of said azimuth pod.

7. The azimuth propeller device of claim 4, wherein said fin is twisted in the rotation direction of said POD propeller member from the front to back of said fin.

* * * * *